US007527908B2

(12) United States Patent
Iwatsuki et al.

(10) Patent No.: US 7,527,908 B2
(45) Date of Patent: May 5, 2009

(54) CARRIER, DEVELOPER, DEVELOPER CONTAINER, IMAGE FORMING METHOD AND PROCESS CARTRIDGE

(75) Inventors: Hitoshi Iwatsuki, Numazu (JP); Tomio Kondou, Numazu (JP); Shinichiro Yagi, Numazu (JP); Kousuke Suzuki, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 398 days.

(21) Appl. No.: 11/398,662

(22) Filed: Apr. 6, 2006

(65) Prior Publication Data

US 2006/0251982 A1 Nov. 9, 2006

(30) Foreign Application Priority Data

Apr. 6, 2005 (JP) ..... 2005-110213
Mar. 28, 2006 (JP) ..... 2006-089413

(51) Int. Cl.
*G03G 9/10* (2006.01)

(52) U.S. Cl. ..... 430/111.1; 430/111.4; 430/124.1

(58) Field of Classification Search ..... 430/111.1, 430/124.1, 111.14
See application file for complete search history.

(56) References Cited

U.S. PATENT DOCUMENTS

| | | | | |
|---|---|---|---|---|
| 6,406,826 | B1 * | 6/2002 | Suzuki et al. | 430/111.35 |
| 6,500,595 | B1 | 12/2002 | Mochizuki et al. | |
| 2004/0234876 | A1 | 11/2004 | Suzuki et al. | |
| 2004/0253528 | A1 * | 12/2004 | Yamashita et al. | 430/111.35 |
| 2005/0003292 | A1 * | 1/2005 | Yamashita et al. | 430/111.33 |
| 2005/0079434 | A1 | 4/2005 | Suzuki et al. | |
| 2006/0024606 | A1 | 2/2006 | Suzuki et al. | |

FOREIGN PATENT DOCUMENTS

| | | |
|---|---|---|
| JP | 54-155048 | 12/1979 |
| JP | 57-40267 | 3/1982 |
| JP | 1-19584 | 10/1982 |
| JP | 58-108548 | 6/1983 |
| JP | 58-108549 | 6/1983 |
| JP | 3-628 | 7/1983 |
| JP | 59-166968 | 9/1984 |
| JP | 2683624 | 3/1990 |
| JP | 5-273789 | 10/1993 |
| JP | 6-202381 | 7/1994 |
| JP | 8-6307 | 1/1996 |
| JP | 9-160304 | 6/1997 |
| JP | 2001-188388 | 7/2001 |
| JP | 2005-24809 | 1/2005 |

OTHER PUBLICATIONS

U.S. Appl. No. 11/870,613, filed Oct. 11, 2007, Iwatsuki, et al.
U.S. Appl. No. 11/608,521, filed Dec. 8, 2006, Satoru, et al.
U.S. Appl. No. 11/958,728, filed Dec. 18, 2007, Nagayama, et al.
Patent Abstracts of Japan—English Abstract of JP 58-108548.
Patent Abstracts of Japan—English Abstract of JP 54-155048.
Patent Abstracts of Japan—English Abstract of JP 57-040267.
Patent Abstracts of Japan—English Abstract of JP 58-108549.
Patent Abstracts of Japan—English Abstract of JP 59-166968.
Patent Abstracts of Japan—English Abstract of JP 57-168255.
Patent Abstracts of Japan—English Abstract of JP 58-117555.
Patent Abstracts of Japan—English Abstract of JP 06-202381.
Patent Abstracts of Japan—English Abstract of JP 05-273789.
Patent Abstracts of Japan—English Abstract of JP 09-160304.
Patent Abstracts of Japan—English Abstract of JP 2001-188388.
Patent Abstracts of Japan—English Abstract of JP 2005-024809.
Patent Abstracts of Japan—English Abstract of JP 08-006307.
Patent Abstracts of Japan—English Abstract of JP 02-079862.
U.S. Appl. No. 12/013,108, filed Jan. 11, 2008, Yagi, et al.
U.S. Appl. No. 12/015,109, filed Jan. 16, 2008, Nagayama, et al.
U.S. Appl. No. 12/040,451, filed Feb. 29, 2008, Saitoh, et al.
U.S. Appl. No. 11/378,424, filed Mar. 20, 2006, Suzuki, et al.
U.S. Appl. No. 11/449,808, filed Jun. 9, 2006, Suzuki, et al.
U.S. Appl. No. 12/189,384, filed Aug. 11, 2008, Imahashi, et al.
U.S. Appl. No. 12/209,607, filed Sep. 12, 2008, Nagayama, et al.

* cited by examiner

*Primary Examiner*—John L Goodrow
(74) *Attorney, Agent, or Firm*—Oblon, Spivak, McClelland, Maier & Neustadt, P.C.

(57) ABSTRACT

A carrier contains a core material; and a coated film containing a binder resin, and a particulate material, the coated film covering the core material, wherein a ratio (D/h) of an average particle diameter (D) of the particulate material to an average thickness (h) of the coated film is from 0.01 to 1, and wherein the carrier has concavities and convexities on the surface of the carrier, the concavities and convexities having a difference of elevation of from 0.05 to 2.0 μm.

16 Claims, 3 Drawing Sheets

CARRIER, DEVELOPER, DEVELOPER CONTAINER, IMAGE FORMING METHOD AND PROCESS CARTRIDGE

BACKGROUND OF THE INVENTION

1. Field of the Invention

The present invention relates to a carrier, a developer, a developer container, an image forming method and a process cartridge.

2. Description of the Related Art

Electrophotographic image forming methods include forming an electrostatic latent image on an image bearer such as a photoconductive material, transferring a charged toner thereto to form a visible image (toner image), transferring the toner image onto a recording medium such as a paper, and fixing the toner image thereon to form a final output image. Recently, electrophotographic copiers and printers are rapidly developed from monochrome to full-color, and full-color markets are expanding.

The electrophotographic image forming methods typically include overlaying three primary color toners, i.e., yellow, magenta and cyan toners or 4 color toners including a black toner to reproduce all colors. Therefore, to produce a sharp full-color image having good color reproducibility, the surface of a fixed toner image has to be smooth to decrease light scattering. This is why many conventional full-color copiers produce images having medium to high glossiness of from 10 to 50%.

As methods of fixing a dry toner image on a recording medium, contact heat fixing methods using a heated roller or a heated belt having smooth surface are typically used. Although the methods have high heat efficiency and are capable of fixing at high speed and imparting gloss and transparency to color toners, offset problems wherein a part of a toner image adheres to a fixing member and transfers to another image occur because of separating the fixing member from the melted toner image after contacting the surface of the fixing member thereto upon application of pressure.

For the purpose of preventing the offset problems, the surface of the fixing member has typically been coated with a silicone rubber or a fluorine-containing resin, and further applied with a release oil such as a silicone oil. However, although this method is quite effectively used to prevent the offset problem, a release oil applicator is required and the resultant fixer becomes large. Therefore, a monochrome toner having high viscoelasticity when melted so as not to internally break is used in order not to apply a release oil to the fixing member (oilless) or to apply a small amount thereof. The monochrome toner has a binder resin with controlled molecular weight distribution and includes a release agent such as a wax.

In addition, even full-color image forming apparatuses are becoming oilless for the purpose of being downsized and simplified. However, as mentioned above, to improve color reproducibility of a color toner, the color toner needs to have lower viscoelasticity because the fixed color toner image is required to have smooth surface. Therefore, the color toner has offset problems more than the monochrome toner and makes it more difficult to make a fixer oilless or use a small amount of oil. A toner including a release agent has higher adherence to an image bearer and lower transferability to a transfer paper. Further, the release agent therein contaminates friction-charged members such as a carrier and lowers the chargeability thereof, resulting in deterioration of the durability of the toner.

On the other hand, hard high-strength covering layers are typically formed on carriers with suitable resins for the purpose of preventing toner constituents from film coating over the surface thereof, leveling the surface thereof, preventing oxidization thereof, preventing deterioration of moisture sensitivity thereof, extending lives of developers, preventing adherence of the carriers to the surfaces of photoreceptors, protecting photoreceptors from being damaged or abraded by the carriers, controlling charge polarity thereof and controlling charge quantity thereof. For example, Japanese Laid-Open Patent Publication No. 58-108548 discloses a carrier coated with a specific resin material; Japanese Laid-Open Patent Publications Nos. 54-155048, 57-40267, 58-108549, 59-166968, 6-202381 and Japanese Patent Publications Nos. 1-19584 and 3-628 disclose carriers including various additives in their coated layers; Japanese Laid-Open Patent Publication No. 5-273789 discloses a carrier having an additive on the surface thereof; Japanese Laid-Open Patent Publication No. 9-160304 discloses a carrier including a particulate electroconductive material having a diameter larger than the thickness of its coated layer; Japanese Laid-Open Patent Publication No. 2001-188388 discloses a carrier wherein the magnitude relation between the thickness of its coated layer and the diameter of the particulate material is specified; and Japanese Laid-Open Patent Publication No. 2005-024809 discloses a carrier wherein the particulate material is surface-treated. Japanese Laid-Open Patent Publication No. 8-6307 discloses a method of using a benzoguanamine-n-butylalcohol-formaldehyde copolymer as a main component for coating materials for carriers. Japanese Patent No. 2683624 discloses a method of using a crosslinked material of a melamine resin and an acrylic resin.

However, these conventional technologies insufficiently improve durability and prevent the carrier adherence. They still have problems of toner spent on the surface of a carrier, causing unstable charge quantity thereof, abrasion of the coated layer and exposition of a core material of the carrier, causing lower resistivity thereof. Initially, quality images can be produced, but the more images are produced, the lower the quality thereof.

In addition, Japanese Laid-Open Patent Publication No. 2001-188388 discloses a method of forming a thin coated film having concavities and convexities on a carrier, but the thin coated film does not have a sufficiently long life because of being abraded sooner and the resistivity of the carrier deteriorates. When simply making the coated film thicker, the surface thereof does not have sufficient concavities and convexities to prevent the toner spent.

Further, demands for producing images more quickly and finely are ever-increasing, and a developer receives more stress than ever and even carriers conventionally having had long lives do not have sufficient lives. Carbon black is typically used as a resistivity adjuster for carriers, and the resultant color image may be contaminated due to desorption of the carbon black.

Because of these reasons, a need exists for a carrier having good durability, capable of preventing adherence thereof.

SUMMARY OF THE INVENTION

Accordingly, an object of the present invention is to provide a carrier having good durability, capable of preventing adherence thereof.

Another object of the present invention is to provide a developer including the carrier.

A further object of the present invention is to provide a developer container containing the developer.

Another object of the present invention is to provide an image forming method using the developer.

A further object of the present invention is to provide a process cartridge using the developer.

These objects and other objects of the present invention, either individually or collectively, have been satisfied by the discovery of a carrier, comprising:

a core material; and a coated film comprising a binder resin, and a particulate material, said coated film covering the core material, wherein a ratio (D/h) of an average particle diameter (D) of the particulate material to an average thickness (h) of the coated film is from 0.01 to 1, and wherein the carrier has concavities and convexities on the surface of the carrier, said concavities and convexities having a difference of elevation of from 0.05 to 2.0 μm.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE PREFERRED EMBODIMENTS

Figure 1:
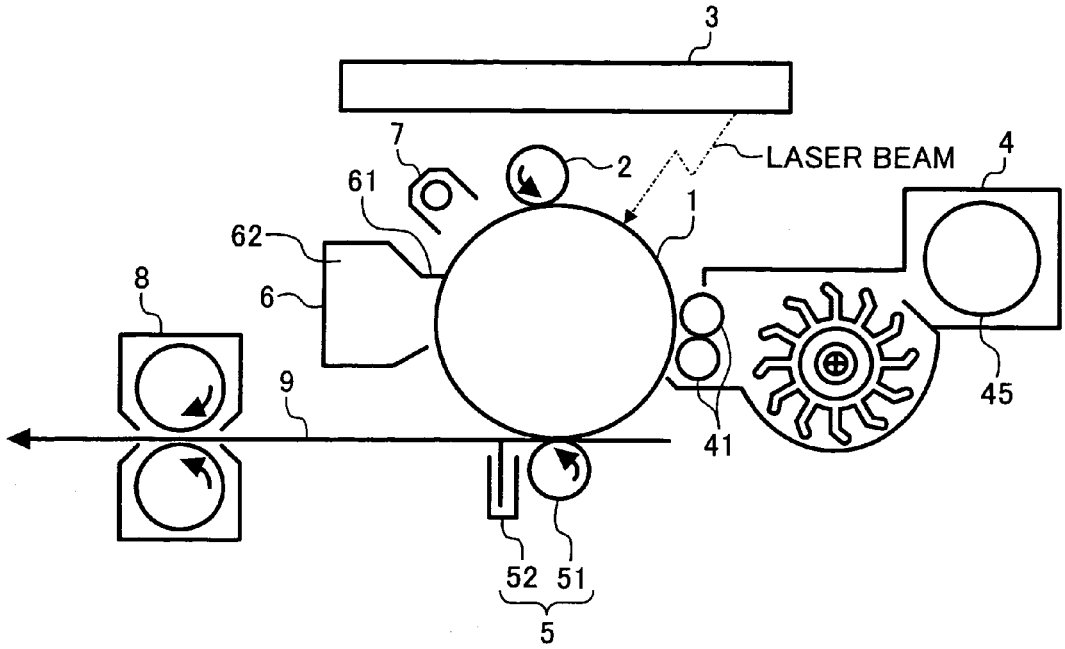
FIG. 1 is a schematic view illustrating an embodiment of an image forming apparatus for use in the present invention.

The present invention provides a carrier having good durability, capable of preventing adherence thereof. The carrier of the present invention preferably comprises a core material and a coated film comprising a binder resin and a particulate material and covering the core material, wherein a ratio (D/h) of an average particle diameter (D) of the particulate material to an average thickness (h) of the coated film is from 0.01 to 1. The ratio (D/h) includes all values and subvalues therebetween, especially including 0.05, 0.1, 0.2, 0.3, 0.4, 0.5, 0.6, 0.7, 0.8 and 0.9. This is why the carrier has good durability and is capable of preventing adherence thereof. When the ratio (D/h) is larger than 1, when images having a low image area are continuously produced, the convexities of the particulate materials are abraded and the resistivity of the carrier lowers, resulting in deterioration of the image quality. When less than 0.01, the carrier scarcely has the concavities and convexities of the particulate materials, and has a flat surface. Therefore, a toner sticking thereto deteriorates the chargeability thereof, resulting in deterioration of image quality.

The thickness (h) of the coated film is an average thickness of a resin covering the surface of the carrier, which is measured by observing the cross-section thereof with a transmission electron microscope. Specifically, the distance from the surface of the carrier to the surface of the coated layer is measured 50 times and an average thereof is determined to be the thickness (h).

The average particle diameter (D) of the particulate material is measured as follows:

placing 30 ml of amino silane (SH6020 from Dow Corning Toray Silicone Co., Ltd.) and 300 ml of toluene in a juicer-mixer;

placing 6.0 g of a sample therein;

dispersing the mixture in the juicer-mixer at a low speed to prepare a dispersion;

placing the dispersion in 500 ml of toluene in a beaker having a capacity of 1,000 ml to be diluted to prepare a dilution; and measuring the volume-average particle diameter of the sample by a centrifugal automatic particle diameter distribution measurer CAPA-700 from Horiba, Ltd. while stirring the dilution constantly by a homogenizer under the following conditions:

rotation speed: 2,000 rpm maximum particle diameter: 2.0 μm minimum particle diameter: 0.1 μm particle diameter interval: 0.1 μm dispersion medium viscosity: 0.59 mPa·s dispersion medium density: 0.87 g/CM$^3$ particle density: the density of the inorganic particulate material is an absolute specific gravity measured by a dry automatic bulk density meter ACUPIC 1330 from Shimadzu Corporation.

The carrier of the present invention has an average difference of elevation of from 0.02 to 3.0 μm, and preferably from 0.05 to 2.0 μm. The average difference of elevation includes all values and subvalues therebetween, especially including 0.05, 0.1, 0.5, 1, 1.5, 2 and 2.5 μm. When larger than 3.0 μm, a toner tends to be firmly fixed on the concavities and chargeability of the carrier deteriorates. In addition, the particulate materials forming convexities separate therefrom and the resistivity thereof deteriorates. When less than 0.02 μm, a toner is less scraped off from the carrier and firmly fixed thereon, resulting in deterioration of chargeability thereof.

The average difference of elevation is an average difference of elevation of a resin covering the surface of the carrier, which is measured by observing the cross-section thereof with a transmission electron microscope. Specifically, the distance from the surface of the carrier to the surface of the coated layer is measured 50 times, and a difference between an average of the maximum 5 distances and an average of the minimum 5 distances is determined to be the average difference of elevation.

When the carrier of the present invention is observed by a scanning electron microscope, the carrier is proved to have concavities and convexities and include the particulate materials. Compared with when D/h is larger than 1, the carrier has less convexities of the particulate materials and a smaller difference of elevation of the concavities and convexities.

However, the convexities thereof are difficult to abrade even when producing images having a low image area because the average thickness of the coated film is thick, and deterioration of the resistivity thereof can be prevented.

The core material of the present invention includes known materials, and is not particularly limited, such as ferrite, Cu—Zn—ferrite, Mn ferrite, Mn—Mg—ferrite, Mn—Mg—Sr ferrite, magnetite iron and nickel. Suitable materials can be selected in accordance with the applications of the carrier. The core material preferably has an average particle diameter of from 15 to 100 μm. The average particle diameter includes all values and subvalues therebetween, especially including 20, 25, 30, 35, 40, 45, 50, 55, 60, 65, 70, 75, 80, 85, 90 and 95 μm. When less than 15 μm, the carrier tends to adhere to an electrostatic latent image bearer. When larger than 100 μm, deterioration of image quality such as a carrier stripe tends to occur.

The particulate material is preferably from 10 to 80% by weight, and more preferably from 40 to 70% by weight based on total weight of the particulate material and the binder resin. The amount of particulate material includes all values and subvalues therebetween, especially including 15, 20, 25, 30, 35, 40, 45, 50, 55, 60, 65, 70 and 75% by weight. When less than 10% by weight, a strong stress to the binder resin cannot effectively be reduced. When greater than 80% by weight, the chargeability of the carrier deteriorates and the particulate material is insufficiently maintained.

The content of the particulate material is calculated as follows:

content of the particulate material (% by weight)=[the particulate material/(the particulate material+ total weight of the solid content of a coated resin)].

A ratio (hereinafter referred to as a coverage of the particulate material) of a product of the cross-section area of the particulate material and the number thereof to a product of the surface area of the core material and the number thereof is preferably from 0.3 to 30. This is why the particulate materials properly stack in the coated film to strengthen the coated film. Therefore, the coated film separates less from the core material and is less abraded, and the carrier has stable quality. The coverage of the particulate material includes all values and subvalues therebetween, especially including 0.5, 1, 2, 4, 6, 8, 10, 12, 14, 16, 18, 20, 22, 24, 26 and 28. When the coverage of the particulate material is less than 0.3, toner sticking to the carrier is not effectively prevented. When greater than 30, the chargeability of the carrier deteriorates and the particulate material is insufficiently maintained.

The coverage of the particulate material can be determined by the following formula:

the coverage of the particulate material=$(Ds\times\rho s\times W)/(4\times Df\times\rho f)$ wherein Ds is an average particle diameter of the core material, ρs is an absolute specific gravity thereof, W is a weight ratio of the particulate material to the core material, Df is an average particle diameter of the particulate material and ρf is an absolute specific gravity thereof. Namely, the surface area of the core material is a surface area of a sphere having the particle diameter Ds. The number of the core material is a weight ratio of the core material to the weight of a sphere having the diameter Ds and the absolute specific gravity ρs. The cross-section area of the particulate material is the area of a circle having the diameter Df. The number of the particulate material is a weight ratio of the particulate material to the weight of a sphere having the diameter Df and the absolute specific gravity ρf. The average particle diameter of the core material can be measured similarly to the average particle diameter (D) of the particulate material.

The carrier of the present invention preferably has a volume resistivity of from $1\times10^{10}$ Ω·cm to $1\times10^{17}$ Ω·cm. The volume resistivity includes all values and subvalues therebetween, especially including $5\times10^{10}$, $1\times10^{11}$, $5\times10^{11}$, $1\times10^{12}$, $5\times10^{12}$, $1\times10^{13}$, $5\times10^{13}$, $1\times10^{14}$, $5\times10^{14}$, $1\times10^{15}$, $5\times10^{15}$, $1\times10^{16}$ and $5\times10^{16}$ Ω·cm. When less than $1\times10^{10}$ Ω·cm, the carrier tends to adhere to non-image areas. When greater than $1\times10^{17}$ Ω·cm, the edge effect deteriorates. When less than the minimum resistivity measurable by a high resist meter, the carrier substantially has no volume resistivity and is considered to be broken down.

Figure 4:
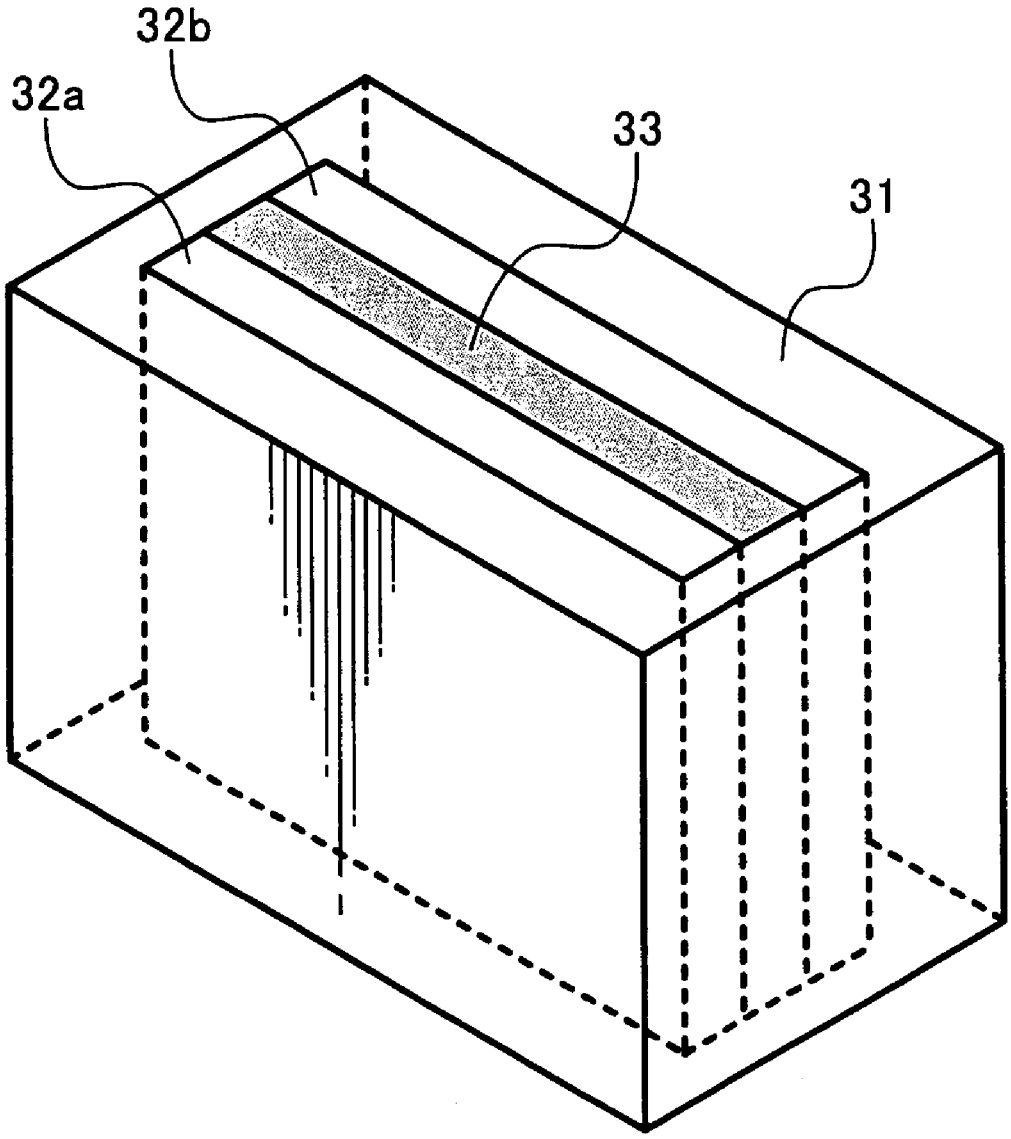
FIG. 4 is a schematic view illustrating a cell for measuring the volume resistivity for use in the present invention.

The volume resistivity is measured as follows:

filling a carrier 33 in a cell 31 formed of a fluorine-containing resin containing electric poles 32*a* and 32*b* having a surface area of 2 cm×4 cm respectively and a gap of 2 mm therebetween as shown in FIG. 4;

tapping the cell 31 by a tapping machine PTM-1 from SANKYO PIO-TECH. CO., Ltd. at 30 times/min for 1 min;

applying a DC voltage of 1,000 V between the electric poles; and measuring a DC resistance by a high resistance meter 4329A from YOKOKAWA HEWLETT PACKARD LTD to determine an electric resistance R in Ω·cm and Log R.

The particulate material is not particularly limited, and preferably an inorganic particulate material such as zinc and barium. Particularly preferably, alumina, silica or titanium are used.

The coated film covering the carrier of the present invention preferably has an average thickness of from 0.05 to 4.00 μm, and more preferably from 0.05 to 1.00 μm. The average thickness includes all values and subvalues therebetween, especially including 0.1, 0.5, 1, 1.5, 2, 2.5, 3 and 3.5 μm. When less than 0.05 μm, the convexities of the particulate materials are scraped or the core material is exposed due to insufficient thickness, resulting in deterioration of the resistivity of the carrier. When thicker than 4.00 μm, the carrier becomes large, resulting in deterioration of chargeability and image definition.

The binder resin preferably has a glass transition temperature of from 20 to 100° C. This is why the binder resin has a suitable elasticity and contact stresses between a toner and the carrier or the carriers when stirred to frictionally charge a developer can be absorbed. The glass transition temperature includes all values and subvalues therebetween, especially including 20, 25, 30, 35, 40, 45, 50, 55, 60, 65, 70, 75, 80, 85, 90 and 95° C. When lower than 20° C., blocking problems tend to occur. When higher than 100° C., the binder resin deteriorates in capability of absorbing stress and tends to be abraded.

The glass transition temperature is specifically determined by the following steps. TA-60WS and DSC-60 from Shimadzu Corporation are used to measure the glass transition temperature under the following conditions.

Sample container: Sample pan made of aluminum (with a lid)

Sample amount: 5 mg

Reference: Sample pan made of aluminum (10 mg of alumina)

Atmosphere: Nitrogen (flow rate 50 ml/min)

Starting temperature: 20° C.

Rising speed of temperature: 10° C./min

Maximum temperature: 150° C.

Holding time: 0

Lowering speed of temperature: 10° C./min

Minimum temperature: 20° C.

Holding time: 0

Rising speed of temperature: 10° C./min

Maximum temperature: 150° C.

The measurement results are analyzed using data analysis software TA-60 version 1.52 from Shimadzu Corporation. A range of ±5° C. is specified with a central focus on a maximum peak point on the lowest temperature side of a DSC differential curve in the second rise of temperature, and a peak temperature is determined using a peak analysis function of the analysis software. Next, the maximum endothermic temperature is determined of the DCS curve using the peak analysis function of the analysis software in the range of the peak temperature ±5° C. This is the glass transition temperature.

The carrier of the present invention preferably has a weight-average particle diameter of from 20 to 65 μm. The weight-average particle diameter includes all values and subvalues therebetween, especially including 25, 30, 35, 40, 45, 50, 55 and 60 μm. When less than 20 μm, the carrier deteriorates in uniformity and tends to have adherence thereof. When larger than 65 μm, reproducibility of image details deteriorates and high-definition images are hard to produce. The weight-average particle diameter of a carrier can be measured by SRA type of MICROTRAC particle size analyzer measuring a range of from 0.7 to 125 μm from NIKKISO CO., LTD., wherein methanol is used as a dispersion liquid and a refractive index thereof is set at 1.33 and those of the carrier and core material are set at 2.42.

The binder resin is preferably a silicone resin. Having a low surface energy, the silicone resin can prevent the toner from sticking.

Specific examples of the silicone resin include any known silicone resins such as unmodified silicones and silicones modified with a resin such as an alkyd resin, a polyester resin, an epoxy resin, an acrylic resin and a urethane resin. Specific examples of marketed products of the unmodified silicones include, but are not limited to, KR271, KR255 and KR152 from Shin-Etsu Chemical Co., Ltd; and SR2400, SR2406 and SR2410 from Dow Corning Toray Silicone Co., Ltd. The unmodified silicone resins can be used alone, and a combination with other constituents crosslinking therewith or charge controlling constituents can also be used. Specific examples of the modified silicones include, but are not limited to, KR206 (alkyd-modified), KR5208 (acrylic-modified), ES1001N (epoxy-modified) and KR305 (urethane-modified) from Shin-Etsu Chemical Co., Ltd; and SR2115 (epoxy-modified) and SR2110 (alkyd-modified) from Dow Corning Toray Silicone Co., Ltd.

The binder resin preferably includes an acrylic resin. Having strong adhesiveness and low brittleness, the acrylic resin stably maintains the coated film, preventing the coated film from being abraded and separating. Further, the particulate material included therein is strongly maintained, particularly when having a particle diameter larger than the average thickness thereof.

Specific examples of the acrylic resin include known acrylic resins. The acrylic resin can be used alone, and a combination with at least one other constituent crosslinking therewith can also be used. Specific examples of the other constituent crosslinking therewith include amino resins such as guanamine and a melamine resin; and acidic catalysts. Specific examples of the acidic catalysts include any materials having a catalytic influence, e.g., materials having a reactive group such as a complete alkyl group, a methylol group, an imino group and a methylol/imino group.

The binder resin preferably includes an acrylic resin and a silicone resin. Since the acrylic resin has a high surface energy, a toner tends to stick to the carrier and accumulate thereon, resulting in deterioration of charge quantity thereof. The silicone resin having a low surface energy solves this problem when used with the acrylic resin. It is important to balance the properties of the two resins because the silicone resin has low adhesiveness and high brittleness. Then, a toner is difficult to stick to the coated film which has good abrasion resistance.

The binder resin is preferably from 0.1% to 1.5% by weight based on total weight thereof and the core material. The amount of binder resin includes all values and subvalues therebetween, especially including 0.2, 0.4, 0.6, 0.8, 1, 1.2 and 1.4% by weight. When less than 0.1% by weight, the coated film does not sufficiently work. When greater than 1.5% by weight, the coated film is more abraded.

The carrier of the present invention preferably has a magnetization of from 40 $Am^2$/kg to 90 $Am^2$/kg at 1,000 Oe, when gaps between the carriers are suitably maintained and a toner is smoothly dispersed with the carrier in a developer. The magnetization includes all values and subvalues therebetween, especially including 45, 50, 55, 60, 65, 70, 75, 80 and 85 $Am^2$/kg. When less than 40 A $m^2$/kg at 1,000 Oe, the carrier adherence tends to occur. When greater than 90 A $m^2$/kg, an ear (magnetic brush) of the developer when developing becomes hard, resulting in deterioration of reproducibility of image details. The magnetization can be measured as follows:

placing 1.0 g of the carrier core material in a cylindrical cell having an inner diameter of 7 mm and a height of 10 mm;

setting the cell in a B-H tracer BHU-60 from Riken Denshi Co., Ltd.;

increasing a (first) magnetic field gradually to 3,000 Oe and decreasing the magnetic field gradually to 0;

increasing an opposite magnetic field gradually to 3,000 Oe and decreasing the magnetic field gradually to 0; and applying a magnetic field again to the same direction of the (first) magnetic field to prepare a B-H curve, from which the magnetization at 1,000 Oe is determined.

The developer of the present invention includes the carrier of the present invention and a toner. The developer produces quality images.

The toner includes known toners such as a monochrome toner and a color toner. The toner includes a binder resin and a colorant, and may be an oilless toner further including a release agent. The oilless toner can even be used in a fixing system wherein an oil preventing the toner from sticking to a fixing roll is not applied thereto. The release agent of the oilless toner typically tends to transfer to the surface of the carrier, however, the carrier of the present invention well avoids this and maintains its good quality. Particularly, an oilless color toner has more of this tendency because of occasionally including a binder resin having a low glass transition temperature, however, the carrier of the present invention solves this problem.

A toner in the developer of the present invention is preferably a color toner. Since the carrier of the present invention does not include carbon black in the coated film, images are not contaminated therewith when the carrier is abraded. Therefore, the carrier of the present invention is preferably included in a color developer placing importance on the color reproducibility. The color toners include toners having colors such as yellow, magenta, cyan, red, green and blue used for producing full-color images besides single-color toners.

Specific examples of the binder resins include any known resins such as homopolymers of styrene and its derivatives such as polystyrene, poly-p-chlorostyrene and polyvinyltoluene; copolymers of styrene such as a styrene-p-chlorostyrene copolymer, a styrene-propylene copolymer, a styrene-vinyltoluene copolymer, a styrene-methyl acrylate copolymer, a styrene-ethyl acrylate copolymer, a styrene-methacrylic acid copolymer, a styrene-methyl methacrylate copolymer, a styrene-ethyl methacrylate copolymer, a styrene-butyl methacrylate copolymer, a styrene-α-chloro methyl methacrylate copolymer, a styrene-acrylonitrile copolymer, styrene-vinyl methyl ether copolymer, a styrene-vinyl methyl ketone copolymer, a styrene-butadiene copolymer, styrene-isoprene copolymer, a styrene-maleate copolymer; a polymethyl methacrylate resin, a polybutyl methacrylate resin, a polyvinylchloride resin, a polyethylene resin, a polyester resin, a polyurethane resin, an epoxy resin, a polyvinylbutyral resin, a polyacrylic acid resin, a rosin resin, a modified rosin resin, a terpene resin, a phenol resin, an aliphatic or aromatic hydrocarbon resin, an aromatic petroleum resin, etc. These can be used alone or in combination. In addition, known binder resins for pressure fixation can be used. Specific examples thereof include low-molecular-weight polyethylene, polyolefin such as low-molecular-weight polypropylene, an ethylene-acrylic acid copolymer, an ethylene-acrylic acid ester copolymer, a styrene-methacrylic acid copolymer, an ethylene-methacrylic acid ester copolymer, an ethylene-vinylchloride copolymer, an ethylene-vinylacetate copolymer, an olefin copolymer such as an ionomer resin, an epoxy resin, a polyester resin, a styrene-butadiene copolymer, polyvinyl pyrrolidone, methylvinylether-maleic acid anhydride, a maleic-acid-modified phenol resin, a phenol-modified terpene resin, etc. These can be used alone or in combination. Known pigments or dyes capable of preparing a yellow, a magenta, a cyan and a black toner can be used as the colorant. Specific examples of the yellow pigments include cadmium yellow, Pigment Yellow 155, benzimidazolone, Mineral Fast Yellow, Nickel Titan Yellow, naples yellow, Naphthol Yellow S, Hansa Yellow G, Hansa Yellow 10G, Benzidine Yellow GR, Quinoline Yellow Lake, Permanent Yellow NCG, Tartrazine Lake, etc.

Specific examples of the orange color pigments include Molybdenum Orange, Permanent Orange GTR, Pyrazolone Orange, Vulcan Orange G, Indanthrene Brilliant Orange GK, etc.

Specific examples of the red pigments include red iron oxide, quinacridone red, cadmium red, Permanent Red 4R, Lithol Red, Pyrazolone Red, Watching Red calcium salts, Lake Red D, Brilliant Carmine 6B, Eosine Lake, Rhodamine Lake B, Alizarine Lake, Brilliant Carmine 3B, etc.

Specific examples of the violet pigments include Fast Violet B, Methyl Violet Lake, etc.

Specific examples of the blue pigments include cobalt blue, Alkali Blue, Victoria Blue Lake, Phthalocyanine Blue, metal-free Phthalocyanine Blue, partialy chlorinated Phthalocyanine Blue, Fast Sky Blue, Indanthrene Blue BC, etc.

Specific examples of the green pigments include a chrome green, chrome oxide, Pigment Green B, Malachite Green Lake, etc.

Specific examples of the black pigments include azine pigments such as carbon black, oil furnace black, channel black, lamp black, acetylene black and aniline black, metal salts of azo pigments, metal oxides, complex metal oxides, etc.

These pigments are used alone or in combination.

Known release agents can be used in the toner. Specific examples thereof include polyethylene, polyolefin such as polypropylene, fatty metal salts, fatty esters, paraffin waxes, amide waxes, polyalcohol waxes, silicone varnishes, carnauba waxes, ester waxes, etc.

The toner can optionally include a charge controlling agent.

Specific examples of the charge controlling agents include Nigrosin; azine dyes including an alkyl group having 2 to 16 carbon atoms disclosed in Japanese Patent Publication No. 42-1627; basic dyes (e.g. C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), Basic Blue 26 (C.I. 44045), C.I. Basic Green 1 (C.I. 42040) and C.I. Basic Green 4 (C.I. 42000)); lake pigments of these basic dyes; C.I. Solvent Black 8 (C.I. 26150); quaternary ammonium salts such as benzoylhexadecylammonium chlorides and decyltrimethyl chlorides; dialkyl tin compounds such as dibuthyl or dioctyl tin compounds; dialkyl tin borate compounds; guanidine derivatives; vinyl polymers including amino groups, polyamine resins such as condensation polymers including an amino group, metal complexes of mono azo dyes disclosed in Japanese Patent Publications Nos. 41-20153, 43-27596, 44-6397 and 45-26478; metal complexes of dicarboxylic acid such as Zn, Al, Co, Cr, and Fe complexes of salicylic acid, dialkylsalicyic acid and naphtoic acid; sulfonated copper phthalocyanine pigments, organic boric salts, quaternary ammonium salts including a fluorine atom, calixarene compounds, etc. For a color toner besides a black toner, a charge controlling agent impairing the original color should not be used, and white metallic salts of salicylic acid derivatives are preferably used.

The toner optionally includes an external additive. Specific examples thereof include inorganic particulate materials such as silica, titanium oxide, alumina, silicon carbonate, silicon nitride and boron nitride; and particulate resins. These are externally added to a parent toner to further improve transferability and durability thereof.

This is because these external additives cover a release agent deteriorating the transferability and durability of a toner and the surface thereof to decrease contact area thereof. The inorganic particulate materials are preferably hydrophobized, and hydrophobized particulate metal oxides such as silica and titanium oxide are preferably used.

The particulate resins such as polymethylmethacrylate and polystyrene fine particles having an average particle diameter of from 0.05 to 1 μm, which are formed by a soap-free emulsifying polymerization method, are preferably used. The average particle diameter includes all values and subvalues therebetween, especially including 0.1, 0.2, 0.3, 0.4, 0.5, 0.6, 0.7, 0.8, and 0.9 μm. Further, a toner including the hydrophobized silica and hydrophobized titanium oxide as external additives, wherein an amount of the hydrophobized silica is larger than that of the hydrophobized titanium oxide, has good charge stability against humidity. A toner including and external additives having a particle diameter larger than that of conventional external additives, such as a silica having a specific surface area of from 20 to 50 $m^2/g$ and particulate resins having an average particle diameter of from 1/100 to 1/8 to that of the toner besides the inorganic particulate materials, has good durability. This is because the external additives having a particle diameter larger than that of the particulate metal oxides prevent the particulate metal oxides from being buried in a parent toner, although tending to be buried therein while the toner is mixed and stirred with a carrier, and charged in an image developer for development. A toner internally including the inorganic particulate materials and particulate resins improves pulverizability as well as transferability and durability although improving less than a toner externally including them. When the external and internal additives are used together, the burial of the external additives in a parent toner can be prevented and the resultant toner stably has good transferability and durability.

Specific examples of the hydrophobizers include dimethyldichlorosilane, trimethylchlorosilane, methyltrichlorosilane, allyldimethylchlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, chloromethyltrichlorosilane, p-chlorophenyltrichlorosilane, 3-chloropropyltrichlorosilane, 3-chloropropyltrimethoxylsilane, vinyltriethoxysilane, vinylmethoxysi lane, vinyl-tris(β-methoxyethoxy)silane, γ-methacryloxypropyltrimethoxysilane, vinyltriacetoxysilane, divinyldichlorosilane, dimethylvinylchlorosilane, octyl-trichlorosilane, decyl-trichlorosilane, nonyl-trichlorosilane, (4-tert-propylphenyl)-trichlorosilane, (4-tert-butylphenyl)-trichlorosilane, dipentyl-dichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-tert-butylphenyl)-octyl-dichlorosilane, dioctyl-dichlorosilane, didecenyl-dichlorosilane, dinonenyl-dichlorosilane, di-2-ethylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosilane, (4-tert-propylphenyl)-diethyl-chlorosilane, octyltrimethoxysilane, hexamethyldisilazane, hexaethyldisilazane, hexatolyldisilazane, etc. Besides these agents, titanate coupling agents and aluminium coupling agents can be used. Besides, as an external additive for the purpose of improving cleanability, lubricants such as a particulate fatty acid metal salt and polyvinylidene fluoride can be used. The toner can be prepared by known methods such as a pulverization method and a polymerization method.

In the pulverization method, as apparatuses for melting and kneading a toner, a batch type two-roll kneading machine, a Bumbury's mixer, a continuous biaxial extrusion machine such as KTK biaxial extrusion machines from Kobe Steel, Ltd., TEM biaxial extrusion machines from Toshiba Machine Co., Ltd., TEX biaxial extrusion machines from Japan Steel Works, Ltd., PCM biaxial extrusion machines from Ikegai Corporation and KEX biaxial extrusion machines from Kurimoto, Ltd. and a continuous one-axis kneading machine such as KO-KNEADER from Buss AG are preferably used. The thereby melted and kneaded materials are cooled and pulverized. A hammer mill, rotoplex, etc. crush the cooled materials, and jet stream and mechanical pulverizers pulverize the crushed materials to preferably have an average particle diameter of from 3 to 15 μm. The average particle diameter includes all values and subvalues therebetween, especially including 4, 6, 8, 10, 12 and 14 μm. Further, the pulverized materials are classified into the materials having particle diameters of from 5 to 20 μm by a wind-force classifier, or any other suitable classifier. The particle diameter includes all values and subvalues therebetween, especially including 6, 8, 10, 12, 14, 16 and 18 μm. Next, an external additive is preferably added to a parent toner. The external additive and parent toner are mixed and stirred by a mixer such that the external additive covers the surface of the parent toner while pulverized. It is essential that the external additives such as inorganic particulate materials and particulate resins are uniformly and firmly fixed to the parent toner to improve durability of the resultant toner.

The developer container of the present invention contains the developer of the present invention.

The developer container can be selected from known containers, and containers having a cap are preferably used.

The container may have a size, a shape, a structure, a material, etc. in accordance with the purpose. The container preferably has a cylindrical shape and spiral concavities and convexities on the inner circumferential face, and a part or all of which are accordion. Such a container transfers a developer therein to a discharge outlet thereof when rotated.

The container is preferably formed of a material having good size preciseness, such as a polyester resin, polyethylene, polypropylene, polystyrene, polyvinylchloride, polyacrylate, a polycarbonate resin, an ABS resin and polyacetal resin.

The developer container of the present invention is easy to store, transport and handle, and detachable from a process cartridge and an image forming apparatus to feed a developer thereto.

The process cartridge of the present invention includes at least an image developer using the developer of the present invention and a photoreceptor, and may include a charger and a cleaner. The process cartridge is detachably installed in an image forming apparatus such as copiers and printers. FIG. 1 is a schematic view illustrating an embodiment of an image forming apparatus including the process cartridge of the present invention. The process cartridge includes a photoreceptor 1, a charger 2, an image developer 4 and a cleaner 6. The photoreceptor 1 rotates at a predetermined peripheral speed. The peripheral surface thereof is positively or negatively charged by the charger 2 uniformly while the photoreceptor rotates. Next, the photoreceptor receives imagewise light from an irradiator 3 such as a slit irradiator and a laser beam scanner to sequentially form an electrostatic latent image on the peripheral surface thereof. Then, the electrostatic latent image is developed by the image developer 4 with a toner to form a toner image. Next, the toner image is transferred onto a transfer material 9 fed between the photoreceptor 1 and a transferer 5 from a paper feeder in synchronization with the rotation of the photoreceptor 1. Then, the transfer material which received the toner image is led to an image fixer 8 fixing the toner image on the transfer material to form a copy image which is discharged out of the apparatus. The discharger is shown as 7. The surface of the photoreceptor 1 is cleaned by the cleaner 6 to remove a residual toner after transferred, and is discharged to repeat forming images. A developing sleeve 41 are present are present. A transfer member 51 and discharging device 52 are also located near the photoreceptor. Cleaning may be provided by a cleaning member 61 and a toner collection room 62.

Figure 2:
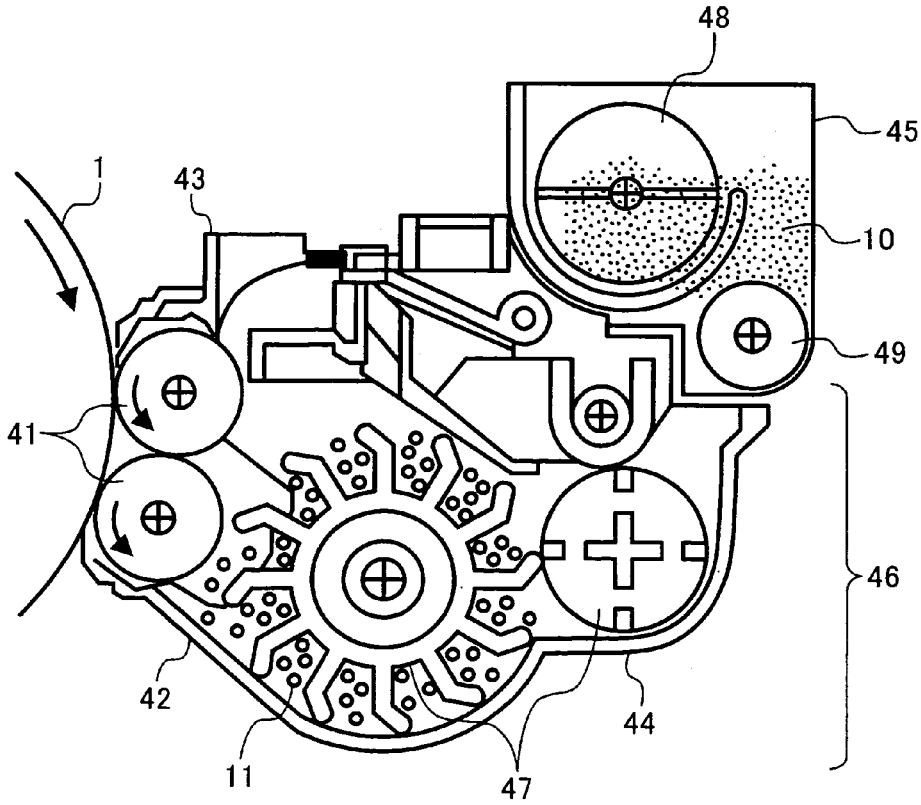
FIG. 2 is a schematic view illustrating an embodiment of an image developer for use in the present invention.

FIG. 2 is an embodiment of an image developer for use in the present invention. An image developer facing a photoreceptor 1 mainly includes a developing sleeve 41 bearing a developer, a developer containing member 42, a doctor blade 43 and a support case 44.

The support case 44 has an opening in the direction of the photoreceptor 1 is combined with a toner hopper 45 as a toner container containing a toner 10. A developer container 46 containing a developer formed of the toner 10 and a carrier 11, which is adjacent to the toner hopper 45, is equipped with a developer stirrer 47 stirring the toner and carrier, and imparting a friction/separation charge to the toner 10. The toner hoper 45 is equipped with a toner agitator 48 rotated by a driver (not shown) and a toner feeder 49 inside. The toner agitator 48 and toner feeder 49 feeds the toner 10 in the toner hopper 45 toward the developer container 46 while agitating the toner 10.

The developing sleeve 41 is located in a space between the photoreceptor 1 and the toner hopper 45. The developing sleeve 41 rotated by a driver (not shown) in a direction indicated by an arrow has a magnet (not shown) inside as a magnetic field generator, which is fixedly located in a relative position to the image developer, to form a magnetic brush with the carrier 11.

The doctor blade 43 is fitted to an opposite side of the support case 44 in a body to a side thereof the developer containing member 42 is fitted to. The doctor blade 43 is located so as to keep a regular clearance between an end thereof and a peripheral surface of the developing sleeve 41 in this embodiment.

The toner 10 fed by the toner agitator 48 and toner feeder 49 from the toner hopper 45 is transported to the developer container 46, where the developer stirrer 47 stirs the toner to impart a desired friction/separation charge thereto. Then, the toner 10 is borne by the developing sleeve 41 with the carrier 11 as a developer 11 and transported to a position facing a peripheral surface of the photoreceptor 1, where the toner 10 is electrostatically bonded with a electrostatic latent image formed on the photoreceptor 1 to form a toner image thereon.

Figure 3:
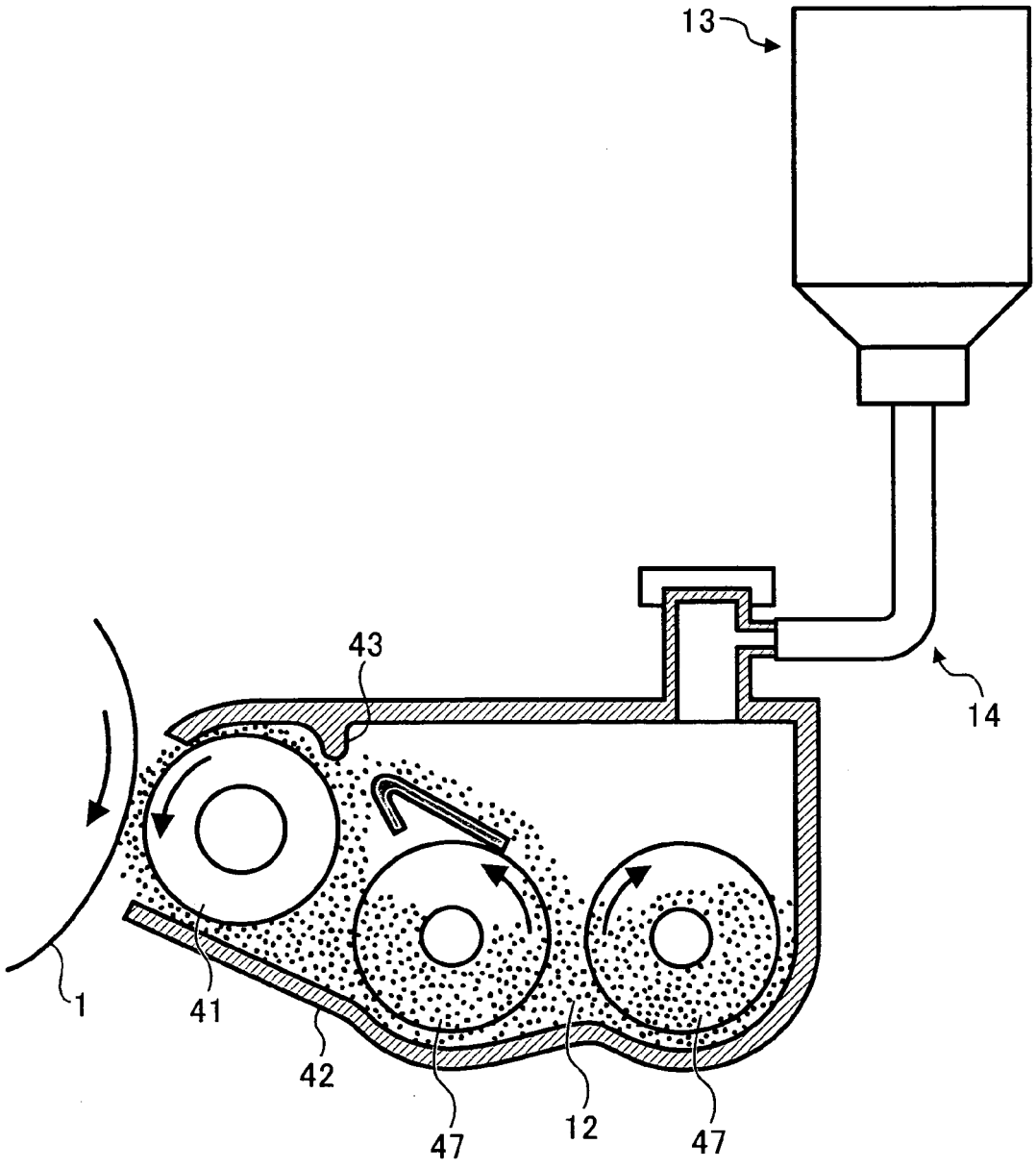
FIG. 3 is a schematic view illustrating another embodiment of an image developer for use in the present invention.

FIG. 3 is another embodiment of an image developer for use in the present invention. The image developer works similarly to the image developer in FIG. 2 except for including a developer container 1 containing the developer of the present invention, and feeding the developer 12 through developer rundown means 14 connected to a developer container 13. A developing sleeve 41 inside a developer containing member 42 including a doctor blade 43 and a developer stirrer may be used.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The following materials were dispersed by a homomixer for 15 min to prepare a liquid solution for forming a coated film.

| | |
|---|---|
| Silicone resin solution SR2410 from Dow Corning Toray Silicone Co., Ltd. | 425 |
| Amino silane SH6020 from Dow Corning Toray Silicone Co., Ltd. | 0.858 |
| Nonconductive alumina having an average particle diameter of 0.3 μm | 85.4 |
| Toluene | 300 |

The liquid solution for forming a coated film was coated and dried on a calcined ferrite powder having a weight-average particle diameter of 35 μm by SPIRA COTA, wherein the temperature was 40° C., from OKADA SEIKO CO., LTD. such that the coated film has a thickness of 0.5 μm. The resultant carrier was calcined in an electric oven at 300° C. for 1 hr. After cooled, the carrier was sieved through openings of 63 μm to have alumina of 50% by weight, a D/h of 0.6, an average difference of elevation of 0.08 μm, a volume resistivity of $10^{14.2}$ Ω·cm and a magnetization of 68 A $m^2$/kg.

The following materials were mixed by a HENSCHEL MIXER, and melted and kneaded by a two-roll mill at 120° C. for 40 min to prepare a kneaded mixture.

| | |
|---|---|
| Polyester resin (having a number-average molecular weight of 3,800, a weight-average molecular weight of 20,000, a glass transition temperature of 60° C. and a softening point of 122° C.) | 100 |
| C.I. Pigment Yellow 180 | 5 |
| Zinc salicylate | 2 |
| Carnauba wax | 3 |

After the kneaded mixture was cooled and hardened, the kneaded mixture was crushed by a hammer mill and pulverized by an air jet pulverizer to prepare a fine powder. The fine powder was classified to prepare a parent toner having an weight-average particle diameter of 5 μm. Further, each 1 part of hydrophobized silica and hydrophobized titanium oxide were mixed with 100 parts of the parent toner by a HENSCHEL MIXER to prepare a final toner.

7 parts of the toner and 93 of the carrier are mixed and stirred to prepare a developer.

Example 2

The following materials were dispersed by a homomixer for 15 min to prepare a liquid solution for forming a coated film.

| | |
|---|---|
| Acrylic resin solution HITALOID 3001 from Hitachi Chemical Co., Ltd., | 118.69 |
| Guanamine solution MYCOAT 106 from Cytec Industries, Inc. | 18 |
| Acidic catalyst 4040 from Cytec Industries, Inc. | 0.68 |
| Nonconductive alumina having an average particle diameter of 0.3 μm | 85.4 |
| Toluene | 800 |

The liquid solution for forming a coated film was coated and dried on a calcined ferrite powder having a weight-average particle diameter of 35 μm by SPIRA COTA, wherein the temperature was 40° C., from OKADA SEIKO CO., LTD. such that the coated film has a thickness of 0.5 μm. The resultant carrier was calcined in an electric oven at 150° C. for 1 hr. After cooled, the carrier was sieved through openings of 63 μm to have alumina of 50% by weight, a D/h of 0.6, an average difference of elevation of 0.08 μm, a volume resistivity of $10^{14.4}$ Ω·cm and a magnetization of 68 A $m^2$/kg.

The procedure for preparation of the developer in Example 1 was repeated to prepare a developer except for using this carrier.

Example 3

The following materials were dispersed by a homomixer for 15 min to prepare a liquid solution for forming a coated film.

| | |
|---|---|
| Acrylic resin solution HITALOID 3001 from Hitachi Chemical Co., Ltd., | 51.61 |
| Guanamine solution MYCOAT 106 from Cytec Industries, Inc. | 16.12 |
| Acidic catalyst 4040 from Cytec Industries, Inc. | 0.28 |
| Silicone resin solution SR2410 from Dow Corning Toray Silicone Co., Ltd. | 241.5 |
| Amino silane SH6020 from Dow Corning Toray Silicone Co., Ltd. | 0.55 |
| Nonconductive alumina having an average particle diameter of 0.3 μm | 86.1 |
| Toluene | 800 |

The procedure for preparation of the developer in Example 2 was repeated to prepare a developer except for using the above-mentioned liquid solution for forming a coated film. The carrier had the alumina of 50% by weight, a D/h of 0.55, an average difference of elevation of 0.08 μm, a volume resistivity of $10^{15.2}$ Ω·cm and a magnetization of 68 A $m^2$/kg.

Example 4

The procedure for preparation of the developer in Example 3 was repeated to prepare a developer except for changing the quantity of the alumina from 86.1 to 8.6. The carrier had the alumina of 9% by weight, a D/h of 0.7, an average difference of elevation of 1.5 μm, a volume resistivity of $10^{12.2}$ Ω·cm and a magnetization of 68 A $m^2$/kg.

Example 5

The procedure for preparation of the developer in Example 3 was repeated to prepare a developer except for changing the quantity of the alumina from 86.1 to 344.4. The carrier had the alumina of 80.1% by weight, a D/h of 0.3, an average difference of elevation of 1.8 μm, a volume resistivity of $10^{16.6}$ Ω·cm and a magnetization of 68 A $m^2$/kg.

Example 6

The procedure for preparation of the developer in Example 3 was repeated to prepare a developer except for changing the quantity of the alumina from 86.1 to 50. The carrier had the alumina of 37% by weight, a D/h of 0.66, an average difference of elevation of 1.3 μm, a volume resistivity of $10^{12.3}$ Ω·cm and a magnetization of 68 A $m^2$/kg.

Example 7

The procedure for preparation of the developer in Example 3 was repeated to prepare a developer except for changing the quantity of the alumina from 86.1 to 250. The carrier had the alumina of 74.5% by weight, a D/h of 0.33, an average difference of elevation of 1.5 μm, a volume resistivity of $10^{16.6}$ Ω·cm and a magnetization of 68 A $m^2$/kg.

Example 8

The procedure for preparation of the developer in Example 3 was repeated to prepare a developer except for changing the quantity of the alumina from 86.1 to 29. The carrier had the alumina of 25.2% by weight, a coverage thereof of 19.9, a D/h of 0.65, an average difference of elevation of 1.1 μm, a volume resistivity of $10^{13.0}$ Ω·cm and a magnetization of 68 A $m^2$/kg.

Example 9

The procedure for preparation of the developer in Example 3 was repeated to prepare a developer except for replacing 86.1 parts of the nonconductive alumina with 15 parts of titanium oxide having an average particle diameter of 0.02 μm. The carrier had the titanium oxide of 14.9% by weight, a coverage thereof of 32.8, a D/h of 0.05, an average difference of elevation of 0.08 μm, a volume resistivity of $10^{14.4}$ Ω·cm and a magnetization of 66 A $m^2$/kg.

Example 10

The procedure for preparation of the developer in Example 3 was repeated to prepare a developer except for replacing 86.1 parts of the nonconductive alumina with 86.1 parts of a surface-treated conductive alumina having an average particle diameter of 0.35 μm and a volume resistivity of 3.5 Ω·cm. The surface-treated layer includes two layers of an underlayer formed of tin dioxide and an upper layer formed of indium oxide including tin dioxide. The carrier had the surface-treated alumina of 50% by weight, a D/h of 0.63, an average difference of elevation of 0.08 μm and a volume resistivity of $10^{9.8}$ Ω·cm.

Example 11

The procedure for preparation of the developer in Example 3 was repeated to prepare a developer except for replacing 241.5 of the silicone resin solution SR2410 with 350.5 thereof and 86.1 parts of the nonconductive alumina with 360.4 parts thereof. The carrier had the alumina of 77% by weight, a D/h of 0.38, an average difference of elevation of 1.8 μm, a volume resistivity of $10^{17.2}$ Ω·cm and a magnetization of 68 A $m^2$/kg.

Example 12

The procedure for preparation of the developer in Example 3 was repeated to prepare a developer except for replacing 51.61 parts of the acrylic resin solution HITALOID 3001 with 5.2 parts thereof, 16.12 parts of the guanamine solution MYCOAT 106 with 1.6 parts thereof, 0.28 parts of the catalyst 4040 with 0.14 parts thereof, 241.5 parts of the silicone resin solution SR2410 with 24.15 parts thereof and 86.1 parts of the nonconductive alumina with 8.5 parts of titanium oxide having an average particle diameter of 0.02 μm. The carrier had the titanium oxide of 50% by weight, a coated film having an average thickness of 0.04 μm, a D/h of 0.5, an average difference of elevation of 0.05 μm and a volume resistivity of $10^{13.0}$ Ω·cm.

Example 13

The procedure for preparation of the developer in Example 3 was repeated to prepare a developer except for replacing 51.61 parts of the acrylic resin solution HITALOID 3001 with 206.4 parts thereof, 16.12 parts of the guanamine solution MYCOAT 106 with 64.4 parts thereof and 241.5 parts of the silicone resin solution SR2410 with 966 parts thereof. The carrier had the alumina of 50% by weight, a coated film having an average thickness of 4.3 μm, a D/h of 0.07, an average difference of elevation of 0.09 μm, a volume resistivity of $10^{16.9}$ Ω·cm and a magnetization of 68 A $m^2$/kg.

Example 14

The procedure for preparation of the developer in Example 3 was repeated to prepare a developer except for replacing 51.61 parts of the acrylic resin solution HITALOID 3001 with 103.2 parts thereof, 16.12 parts of the guanamine solution MYCOAT 106 with 32.2 parts thereof and 241.5 parts of the silicone resin solution SR2410 with 483 parts thereof. The carrier had the alumina of 33.5% by weight, a coated film having an average thickness of 2.1 μm, a D/h of 0.07, an average difference of elevation of 0.06 μm, a volume resistivity of $10^{16.8}$ Ω·cm and a magnetization of 68 A $m^2$/kg.

Example 15

The procedure for preparation of the developer in Example 3 was repeated to prepare a developer except for coating the liquid solution for forming a coated film on a calcined ferrite powder having a weight-average particle diameter of 35 μm and a low agnetization. The carrier had the alumina of 50% by weight, a D/h of 0.55, a volume resistivity of $10^{15.2}$ Ω·cm and a magnetization of 36 A $m^2$/kg.

Example 16

The procedure for preparation of the developer in Example 3 was repeated to prepare a developer except for coating the liquid solution for forming a coated film on a calcined ferrite powder having a weight-average particle diameter of 35 μm and a high magnetization. The carrier had the alumina of 50% by weight, a D/h of 0.55, a volume resistivity of $10^{15.3}$ Ω·cm and a magnetization of 94 A $m^2$/kg.

Example 17

The procedure for preparation of the developer in Example 3 was repeated to prepare a developer except for replacing 51.61 parts of the acrylic resin solution HITALOID 3001 with 206.4 parts thereof, 16.12 parts of the guanamine solution MYCOAT 106 with 64.4 parts thereof, 241.5 parts of the silicone resin solution SR2410 with 966 parts thereof and 86.1 parts of the nonconductive alumina with 172.2 parts thereof, and changing the weight-average particle diameter of the resultant carrier to 19 μm. The carrier had the alumina of 53% by weight, a D/h of 0.52, an average difference of elevation of 1.1 μm, a volume resistivity of $10^{15.0}$ Ω·cm and a magnetization of 94 A $m^2$/kg.

Example 18

The procedure for preparation of the developer in Example 3 was repeated to prepare a developer except for changing the weight-average particle diameter of the resultant carrier to 67 μm. The carrier had the alumina of 49% by weight, a D/h of 0.27, an average difference of elevation of 0.055 μm, a volume resistivity of $10^{12.5}$ Ω·cm and a magnetization of 69 A $m^2$/kg.

Comparative Example 1

The procedure for preparation of the developer in Example 3 was repeated to prepare a developer except for replacing 51.61 parts of the acrylic resin solution HITALOID 3001 with 25 parts thereof, 16.12 parts of the guanamine solution MYCOAT 106 with 8 parts thereof, 0.28 parts of the catalyst 4040 with 0.14 parts thereof, 241.5 parts of the silicone resin solution SR2410 with 120.5 parts thereof and 86.1 parts of the nonconductive alumina with 28.7 parts thereof. The carrier had the alumina of 40.5% by weight, a D/h of 1.13, an average difference of elevation of 1.95 μm, a volume resistivity of $10^{13.2}$ Ω·cm and a magnetization of 68 A $m^2$/kg.

Comparative Example 2

The procedure for preparation of the developer in Example 3 was repeated to prepare a developer except for replacing 51.61 parts of the acrylic resin solution HITALOID 3001 with 206.4 parts thereof, 16.12 parts of the guanamine solution MYCOAT 106 with 64.4 parts thereof, 241.5 parts of the silicone resin solution SR2410 with 966 parts thereof and 86.1 parts of the nonconductive alumina with 430 parts of titanium oxide having an average particle diameter of 0.02 μm, and changing the weight-average particle diameter of the resultant carrier to 19 μm. The carrier had the titanium oxide of 71.6% by weight, a D/h of 0.009, an average difference of elevation of 0.055 μm, a volume resistivity of $10^{16.5}$ Ω·cm and a magnetization of 68 A $m^2$/kg.

Comparative Example 3

The following materials were dispersed by a homomixer for 10 min to prepare a liquid solution for forming a coated film.

| | |
|---|---|
| Acrylic resin solution HITALOID 3001 from Hitachi Chemical Co., Ltd., | 56.0 |
| Guanamine solution MYCOAT 106 from Cytec Industries, Inc. | 15.6 |
| Alumina having an average particle diameter of 0.3 μm and a resistivity of $10^{14}$ Ω · cm | 160.0 |
| Toluene | 900 |
| Butyl cellosolve | 900 |

The procedure for preparation of the developer in Example 3 was repeated to prepare a developer except for coating and drying the liquid solution for forming a coated film on a calcined ferrite powder having a weight-average particle diameter of 35 μm by SPIRA COTA, wherein the temperature was 40° C., from OKADA SEIKO CO., LTD. such that the coated film has a thickness of 0.15 μm. The carrier had the alumina of 80% by weight, a D/h of 2.0, an average difference of elevation of 0.01 μm, a volume resistivity of $10^{15.1}$ Ω·cm and a magnetization of 68 A $m^2$/kg.

Comparative Example 4

The following materials were dispersed by a homomixer for 10 min to prepare a liquid solution for forming a coated film.

| | |
|---|---|
| Acrylic resin solution HITALOID 3001 from Hitachi Chemical Co., Ltd., | 56.0 |
| Guanamine solution MYCOAT 106 from Cytec Industries, Inc. | 15.6 |
| Silicone resin solution SR2410 from Dow Corning Toray Silicone Co., Ltd. | 241.5 |
| Alumina having an average particle diameter of 0.3 μm and a resistivity of $10^{14}$ Ω · cm | 88.3 |
| Toluene | 900 |

The procedure for preparation of the developer in Example 3 was repeated to prepare a developer except for coating and drying the liquid solution for forming a coated film on a calcined ferrite powder having a weight-average particle diameter of 35 μm by SPIRA COTA, wherein the temperature was 40° C., from OKADA SEIKO CO., LTD. such that the coated film has a thickness of 0.55 μm. The carrier had the alumina of 50% by weight, a D/h of 0.55, an average difference of elevation of 0.008 μm, a volume resistivity of $10^{15.1}$ Ω·cm and a magnetization of 68 A $m^2$/kg.

Comparative Example 5

The procedure for preparation of the developer in Example 3 was repeated to prepare a developer except for replacing 86.1 parts of the nonconductive alumina with 258.1 parts thereof, and dispersing the liquid solution for forming a coated film by a homomixer for 10 min. The carrier had the alumina of 68% by weight, a D/h of 0.41, an average difference of elevation of 2.2 μm, a volume resistivity of $10^{15.2}$ Ω·cm and a magnetization of 68 A $m^2$/kg.

The developers prepared in Examples 1 to 18 and Comparative Examples 1 to 5 were evaluated by the following methods and conditions. The results are shown in Table 1.

Carrier Adherence

Each of the developers was set in a modified digital color printer IPSiO CX8200 from Ricoh Company, Ltd. After a non-image chart was developed fixing the background potential at 150 V thereby, 5 points (100 $cm^2$/point) of the surface of a photoreceptor therein were observed with a loupe and an average number of the carrier transferred thereto was determined.

◎: 20 or less
○: 21 to 60
Δ: 61 to 80
x: 81 or more
◎, ○ and Δ were acceptable and x was unacceptable.

Edge Effect

Each of the developers was set in a modified digital color printer IPSiO CX8200 from Ricoh Company, Ltd. A test pattern having a large image area was produced thereby, and a difference of image density between a center and an edge thereof was evaluated.

◎: there was no difference
○: there was a slight difference
Δ: there was a difference
x: there was a large difference
◎, ○ and Δ were acceptable and x was unacceptable.

Image Reproducibility

Each of the developers was set in a modified digital color printer IPSiO CX8200 from Ricoh Company, Ltd. A letter chart having an image area of 5% and a letter of 2 mm×2 mm was produced thereby, and the image reproducibility thereof was evaluated.

◎: very good
○: good
Δ: practically usable
x: practically unusable
◎, ○ and Δ were acceptable and x was unacceptable.

Durability

Each of the developers was set in a modified digital color printer IPSiO CX8200 from Ricoh Company, Ltd. After 100,000 monochrome images were continuously produced thereby, a charge loss and a resistivity loss of the carrier were evaluated.

The charge loss is a difference (Q1−Q2) between a charge quantity Q1 of the initial carrier and a charge quantity Q2 of the carrier after 100,000 monochrome images were continuously produced, wherein the charge quantity Q2 was measured by separating 95 parts of the carrier from 5 parts of the toner with a blow-off apparatus TB-200 from Toshiba Chemical Co., Ltd. after 100,000 images were produced. The difference is preferably 10.0 μC/g or less. The change loss is caused by a toner spent on the carrier, and therefore the charge loss can be prevented when the toner spent thereon is reduced.

The resistivity loss is an absolute value of a difference (|R1−R2|) between a resistivity loss R1 of the initial carrier and a resistivity loss R2 after 100,000 images were produced, wherein the resistivity loss R2 was measured by separating the carrier from the toner with a blow-off apparatus TB-200 from Toshiba Chemical Co., Ltd. after 100,000 images were produced. The respective resistivities were measured by placing the respective carriers in a gap of 2 mm between parallel electrodes of a high resist meter, applying a DC voltage of 250 V thereto for 30 sec to measure the resistivities, and converting the resultant resistivities to a volume resistivities R1 and R2. The difference is preferably 3.0 Ω·cm or less. The resistivity loss is caused by abrasion of the coated film of the carrier, a toner spent thereon and a separation of a particulate material from the coated film thereof. Therefore, the resistivity loss can be prevented when these are reduced.

TABLE 1

| | Carrier adherence | Edge effect | Reproducibility | Durability: Charge loss (μC/g) | Durability: Resistivity loss [Log(Ω · cm)] |
|---|---|---|---|---|---|
| Example 1 | ◎ | ◎ | ◎ | 2.0 | 1.5 |
| Example 2 | ◎ | ◎ | ◎ | 1.3 | 0.6 |
| Example 3 | ◎ | ◎ | ◎ | 1.0 | 0.1 |
| Example 4 | ○ | ◎ | ○ | 6.9 | 1.0 |
| Example 5 | ◎ | ○ | ◎ | 1.7 | 3.8 |
| Example 6 | ◎ | ◎ | ◎ | 3.3 | 0.6 |
| Example 7 | ◎ | ○ | ◎ | 1.7 | 1.2 |
| Example 8 | ◎ | ◎ | ◎ | 4.4 | 2.0 |
| Example 9 | ◎ | ◎ | Δ | 4.3 | 2.9 |
| Example 10 | Δ | ◎ | ◎ | 1.8 | 1.2 |
| Example 11 | ◎ | Δ | ◎ | 1.5 | 1.0 |
| Example 12 | ◎ | ◎ | ○ | 3.9 | 2.8 |
| Example 13 | ◎ | ○ | Δ | 2.9 | 0.8 |
| Example 14 | ◎ | ○ | ○ | 5.2 | 0.8 |
| Example 15 | Δ | Δ | Δ | 4.3 | 2.0 |
| Example 16 | ◎ | ○ | Δ | 5.1 | 2.1 |
| Example 17 | Δ | ◎ | ◎ | 4.5 | 1.2 |
| Example 18 | ◎ | ◎ | Δ | 3.2 | 1.5 |
| Comparative Example 1 | X | ◎ | ○ | 2.5 | 4.8 |
| Comparative Example 2 | ◎ | ○ | Δ | 10.2 | 2.8 |
| Comparative Example 3 | X | Δ | Δ | 12 | 5.2 |
| Comparative Example 4 | Δ | ○ | Δ | 12.8 | 3.5 |
| Comparative Example 5 | ◎ | ○ | Δ | 5.5 | 5.5 |

Table 1 shows that the developers prepared in Examples 1 to 17 had good carrier adherence resistance, edge effect and image reproducibility, and well prevented charge and resistivity loss.

The carrier prepared in Comparative Example 1 did not have a coated layer having a sufficient thickness, and had a problem of abrasion resistance.

The carrier prepared in Comparative Example 2 did not have a coated layer having sufficient concavities and convexities, and a toner spent thereon was not sufficiently scraped off, resulting in a large charge loss.

The liquid solution for forming a coated film prepared Comparative Example 3 was not sufficiently stirred and the alumina was not sufficiently dispersed. Therefore, the resultant coated layer having sufficient concavities and convexities, and a toner spent thereon was not sufficiently scraped off, resulting in a large charge loss. In addition, the coated layer tended to locally peel off because the alumina was not sufficiently dispersed, resulting in a large resistivity loss.

The liquid solution for forming a coated film prepared Comparative Example 4 was not sufficiently stirred and the alumina was not sufficiently dispersed. Therefore, the resultant coated layer having sufficient concavities and convexities, and a toner spent thereon was not sufficiently scraped off, resulting in a large charge loss.

The liquid solution for forming a coated film prepared Comparative Example 5 was not sufficiently stirred, and the alumina was not sufficiently dispersed and agglutinated in the resultant coated layer. A toner spent thereon could be scraped off because the coated layer had large concavities and convexities, but they are so large that the toner tended to stay in the concavities. Further, a large block of the coated layer peeled off when stressed.

This application claims priority and contains subject matter related to Japanese Patent Applications Nos. 2005-110213 and 2006-089413, filed on Apr. 6, 2005 and Mar. 28, 2006 respectively, the entire contents of each of which are hereby incorporated by reference.

Having now fully described the invention, it will be apparent to one of ordinary skill in the art that many changes and modifications can be made thereto without departing from the spirit and scope of the invention as set forth therein.

The invention claimed is:

1. A carrier, comprising:

a core material; and a coated film comprising a binder resin, and a particulate material, said coated film covering the core material, wherein a ratio (D/h) of an average particle diameter (D) of the particulate material to an average thickness (h) of the coated film is from 0.01 to 1, and wherein the carrier has concavities and convexities on the surface of the carrier, said concavities and convexities having a difference of elevation of from 0.05 to 2.0 μm wherein the coated film has an average thickness of from 0.05 to 4.00 μm.

2. The carrier of claim 1, wherein an amount of the particulate material is from 10 to 80% by weight, based on total weight of the binder resin and the particulate material.

3. The carrier of claim 2, wherein an amount of the particulate material is from 40 to 70% by weight, based on total weight of the binder resin and the particulate material.

4. The carrier of claim 1, wherein a coverage of the particulate material is a ratio from 0.3 to 30.

5. The carrier of claim 1, wherein the carrier has a volume resistivity of from $1\times10^{10}$ Ω·cm to $1\times10^{17}$ Ω·cm.

6. The carrier of claim 1, wherein the particulate material is a member selected from the group consisting of alumina, silica, titanium and mixtures thereof.

7. The carrier of claim 1, wherein the coated film has an average thickness of from 0.05 to 2.00 μm.

8. The carrier of claim 1, wherein the binder resin has a glass transition temperature of from 20 to 100° C.

9. The carrier of claim 1, wherein the carrier has a weight-average particle diameter of from 20 to 65 μm.

10. The carrier of claim 1, wherein the binder resin comprises at least one member selected from the group consisting of a silicone resin, an acrylic resin and mixtures thereof.

11. The carrier of claim 1, wherein the carrier has a magnetization of from 40 to 90 A $m^2$/kg.

12. A two-component developer, comprising:

the carrier according to claim 1; and a toner.

13. The two-component developer of claim 12, wherein the toner is a color toner.

14. A container containing the two-component developer according to claim 12.

15. An image forming method, comprising:

charging an image bearer;

irradiating the image bearer to form an electrostatic latent image thereon;

developing the electrostatic latent image with the developer according to claim 12 to form a toner image on the image bearer;

transferring the toner image onto a transfer medium; and fixing the toner image on the transfer medium.

16. A process cartridge, comprising:

at least an image developer comprising the developer according to claim 12 and a photoreceptor.

* * * * *